United States Patent [19]

Jennings

[11] Patent Number: 5,069,418

[45] Date of Patent: Dec. 3, 1991

[54] DEVICE FOR LEVELING CONCRETE FORM ASSEMBLIES

[75] Inventor: Albert L. Jennings, Des Moines, Iowa

[73] Assignee: Economy Forms Corporation, Des Moines, Iowa

[21] Appl. No.: 461,354

[22] Filed: Jan. 5, 1990

[51] Int. Cl.[5] ..... E04G 17/14

[52] U.S. Cl. ..... 249/210; 52/126.4; 52/126.7; 249/219.1

[58] Field of Search ..... 52/726, 126.1, 126.3, 52/126.4, 126.7; 33/404, 406, 410, 1 LE; 249/3, 34, 207, 210, 219.1; 248/180, 188.4

[56] References Cited

U.S. PATENT DOCUMENTS

| | | | |
|---|---|---|---|
| 2,386,494 | 10/1945 | Nagle | 52/126.7 |
| 2,936,051 | 5/1960 | Martin | 52/726 |
| 3,389,471 | 6/1968 | Blake | 33/406 |
| 3,422,539 | 1/1969 | Schneider | 33/406 |
| 3,487,598 | 1/1970 | Lopina | 52/126.4 |
| 3,785,109 | 1/1974 | Letourneur | 52/726 |
| 3,917,214 | 11/1975 | Ratcliff et al. | 249/219.1 |
| 3,966,164 | 6/1976 | Dashew | 249/18 |
| 3,968,605 | 7/1976 | Lovgren | 52/126.7 |
| 3,974,995 | 8/1976 | Blonde | 249/210 |
| 3,998,025 | 12/1976 | Nestroy | 52/126.7 |
| 4,007,507 | 2/1977 | Hansen | 52/726 |
| 4,036,466 | 7/1977 | Van Meter | 249/210 |
| 4,086,734 | 5/1978 | Hayashi | 52/126.4 |
| 4,811,927 | 3/1989 | Slonimsky et al. | 249/210 |
| 4,932,134 | 6/1990 | Meadows | 33/1 LE |
| 4,964,256 | 10/1990 | McCracken | 52/726 |

FOREIGN PATENT DOCUMENTS

| | | | |
|---|---|---|---|
| 2048334A | 12/1980 | United Kingdom | 52/126.7 |

*Primary Examiner*—Jay H. Woo
*Assistant Examiner*—Robert B. Davis
*Attorney, Agent, or Firm*—Kent A. Herink; Brian J. Laurenzo

[57] ABSTRACT

A device for leveling a longitudinally extended concrete form assembly including a ground-supported upright supporting beam wherein a block member for a threaded leveling screw is held in engagement with the upper surface of a lower end plate of the upright beam. The leveling screw is in axial alignment with a central throughbore of the end plate whereby on rotation of the leveling screw will extend and retract and lower end thereof relative to the bottom surface of the end plate to raise and lower the upright beam relative to the ground.

3 Claims, 1 Drawing Sheet

FIG. 5
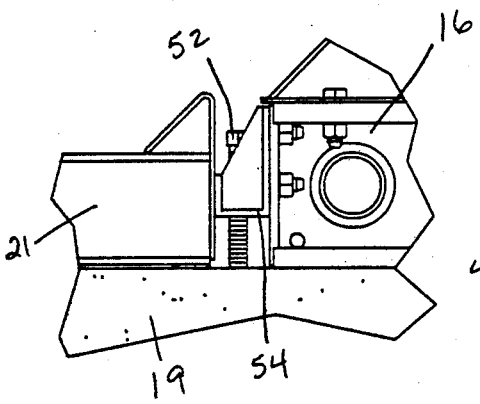
FIG. 4
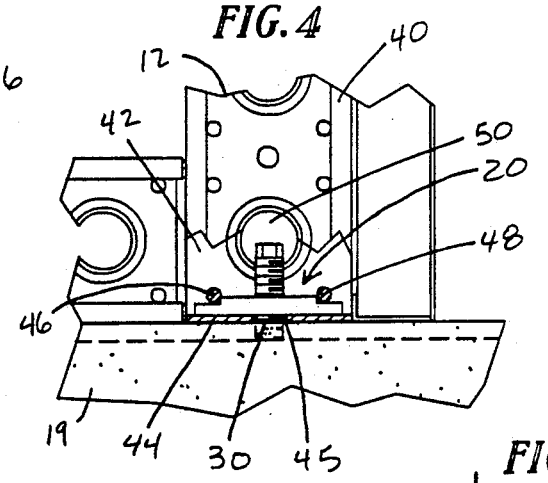
FIG. 1
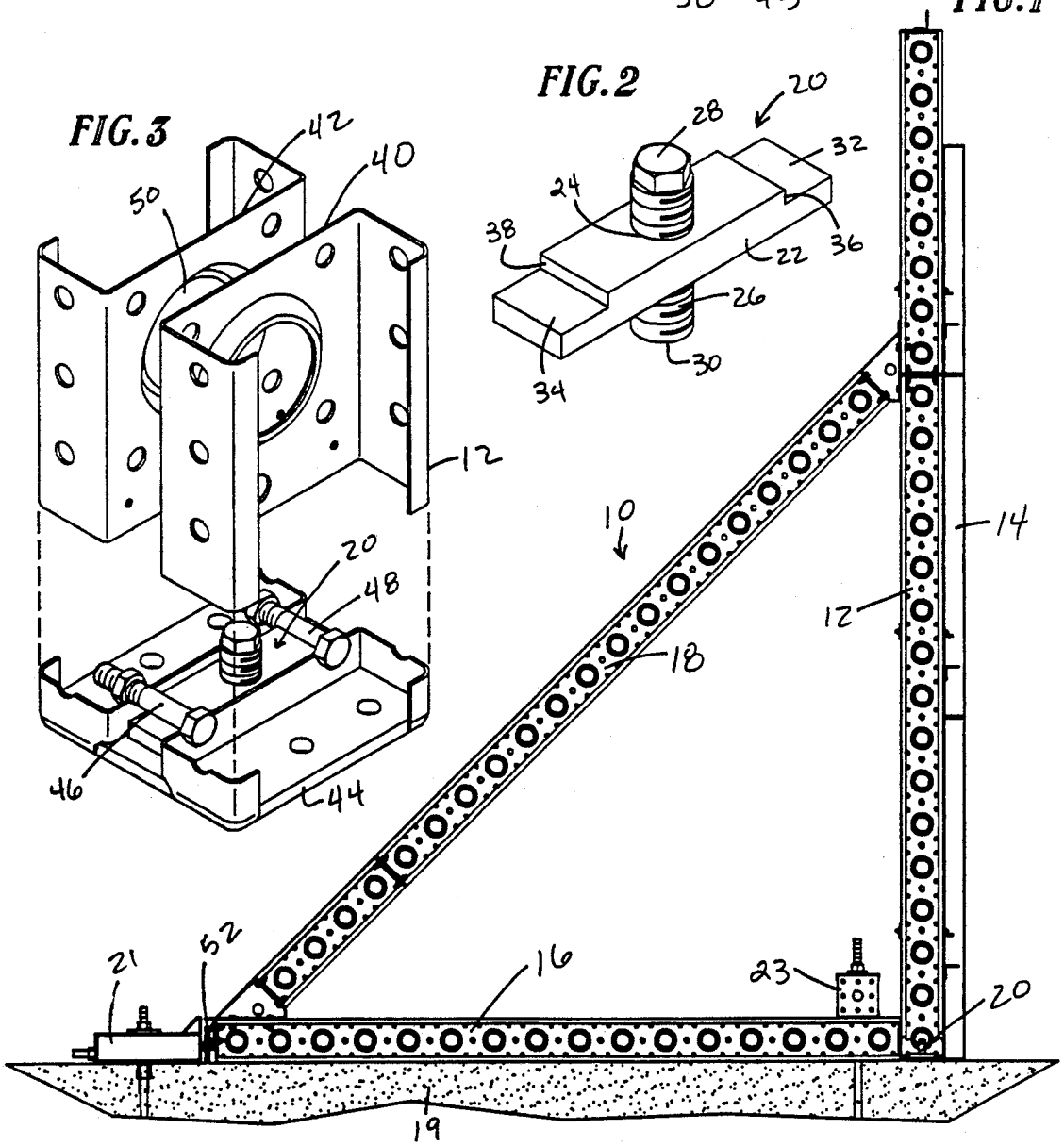
FIG. 2
FIG. 3

DEVICE FOR LEVELING CONCRETE FORM ASSEMBLIES

BACKGROUND OF THE INVENTION

The invention relates to concrete form assemblies and more specifically, to a device for leveling a longitudinally extended concrete form assembly.

Concrete forming systems are well known and widely used in the construction of concrete structures. Individual form components are interconnected to create form assemblies of extended length and height. Certain forming systems employ beams that are used as upright soldiers, horizontal structural extensions, brace members, and the like. To form plumb and level concrete structures, it is important that the form assemblies be adjustable to be both plumb and level. The leveling device of the present invention is mounted at the end portions of certain of the upright structural beams for quick and convenient leveling of an extended form assembly.

SUMMARY OF THE INVENTION

The leveling device of this invention is secured to the lower end portion of an upright beam and is useful for leveling a concrete form assembly of which the beam is a component. The beam is formed of a pair of channel members arranged in a back-to-back, spaced relation and connected together at each end by an end plate having a central throughbore. A block member is secured between the channel members in resting engagement on the upper surface of the lower end plate and includes a threaded throughbore in axial alignment with the bore in the end plate which receives in threaded engagement an upright leveling screw. The leveling screw has a head portion that extends above the block member and a foot portion that, on rotation of the head portion, is extensible and retractable relative to the bottom surface of the lower end plate. Extension and retraction of the foot portion below the bottom surface of the lower end plate will raise and lower the beam to assist in leveling the form assembly.

BRIEF DESCRIPTION OF THE DRAWINGS

FIG. 1 is an end elevational view of a metal concrete form shown in assembly relation with an upright beam on which is mounted the leveling device of the present invention;

FIG. 2 is an enlarged detail perspective view of a mounting block and leveling screw of the leveling device;

FIG. 3 is an enlarged detail perspective view of the leveling device shown in assembly with channel members of the upright beam, parts of which have been broken away for clarity;

FIG. 4 is an enlarged elevational detail view of the leveling device and part of the form assembly of FIG. 1 and showing the leveling screw retracted within the upright beam showing in broken-line the leveling screw extended to raise the upright beam; and FIG. 5 is an enlarged elevational detail view of a screw jack at the distal end portion of a horizontal beam of the form assembly.

DETAILED DESCRIPTION OF A PREFERRED EMBODIMENT

Illustrated in FIG. 1, generally at 10, is a metal concrete form assembly for use in forming a concrete wall structure in assembly relation with a plurality of supporting beam structures only one of which is illustrated. Secured to an upright supporting beam 12 are a plurality of concrete forms 14 against which concrete will be poured and cured to form a concrete wall structure. Associated with each upright beam 12 is a laterally extended horizontal, ground-supported beam 16 and an inclined brace beam 18 interconnecting the upright beam 12 and the horizontal beam 16. The assembly 10 is shown supported on a concrete pad 19 but, of course, may be supported on any stable surface. A blocking member 21 is secured to the concrete pad 19 and is used to adjust the position of the horizontal beam 16 and to prevent it from being pushed outwardly by wet and curing concrete poured against the wall forms 14. A tie-down 23 is also secured to the concrete and pad 19 and serves to hold the form assembly 10 downwardly against the concrete pad 19.

Located at the bottom end portion of each of the upright beams 12 is a leveling device 20 that is used to raise and lower the upright beams 12 and horizontally level the extended form assembly 10. The lower end portion of the upright beam 12 is illustrated in FIG. 3. Each beam 12 includes a pair of spaced-apart, back-to-back channel members 40 and 42 having an end plate 44 secured to the ends thereof. The leveling device 20 is located between the channel members 40 and 42 and is in resting engagement on the upper surface of the end plate 44.

The leveling device 20 includes a block member 22 having a threaded throughbore 24 which receives in threaded engagement a threaded leveling screw 26 (FIG. 2). Extended above the block member 22 is a hexagonal head portion 28 of the leveling screw 26 which can be engaged for rotation of the leveling screw 26 by an appropriately sized conventional wrench. The lower end of the leveling screw 26 is a foot portion 30 that is retractable and extensible relative to the block member 22 upon rotation of the leveling screw 26. In the preferred embodiment, the block member 22 is of an inverted T-shape wherein longitudinal end portions 32 and 34 of the block member 22 are of a reduced thickness thereby forming a pair of shoulders 36 and 38, respectively, for mounting of the block member 22 on the beam 12.

The threaded throughbore and leveling screw 26 of the leveling device 20 are in axial alignment with a central throughbore 45 (FIG. 4) in the end plate 44. The leveling device 20 is securely held between the channel members 40 and 42 and atop the end plate 44 by a pair of bolt assemblies 46 and 48 that pass through aligned openings in the web sections of the channel members 40 and 42. The nut and bolt assemblies 46 and 48 are in contact engagement with the reduced end portions 32 and 34 and the shoulders 36 and 38, as best illustrated in FIG. 4.

In use with a metal concrete form assembly 10 (FIG. 4), the foot portion 30 can be retracted relative to the body member 22 and the end plate 44 so as not to extend beyond the lower surface of the end plate 44. In this position of the leveling device 20, the upright beam 12 will be in its lowest position with the end plate 44 in resting engagement on the concrete pad 19 (FIG. 4). Extension of the leveling screw 26 is achieved by clockwise rotation of the head portion 28 which is accessible either through the space between the spaced-apart channel members 40 and 42 (FIG. 3) or through a large opening 50 in the web sections of the channel members (FIG. 4). From the position shown solid-line in FIG. 4, clockwise rotation of the leveling screw 26 will extend the foot portion 30 into contact engagement with the concrete pad 19. Further clockwise rotation will act to raise the end plate 44, and consequently the upright beam 12, above the concrete pad 19 as illustrated in broken-line in FIG. 4. From the raised position, rotation of the leveling screw in a counter-clockwise direction will, of course, lower the upright beam 12 until the end plate 44 is again resting atop the concrete pad 19.

Since the upright beam 12 is part of a longitudinally extended form assembly 10 (FIG. 1), the leveling device 20 can be used to raise and lower one portion of the form assembly 10 relative to another. The form assembly 10 can thereby be horizontally leveled. Two-axis leveling of the form assembly 10 can be accomplished by adjustment of a conventional screw jack 52 located at the distal end portion of the horizontal beam 16 and supported thereon in a mounting bracket 54 that is substantially J-shaped in transverse cross section (FIG. 5). Raising and lowering of the end of the horizontal beam 16 by rotation of the leveling jack 52 will adjust the vertical alignment of the concrete forms 14 with the upright beam 12. By appropriate adjustment of the leveling jacks 52, the concrete forms 14 can be vertically aligned so that a plumb concrete wall structure will result.

Although the invention has been described with respect to a preferred embodiment thereof, it is to be understood that it is not to be so limited since changes and modifications can be made therein which are within the full intended scope of the invention as defined in the following claims.

I claim:

1. A device for leveling a longitudinally extended concrete form assembly, said leveling device comprising an upright supporting beam formed by a pair of upright elongated members arranged in spaced relation and connected together at each end by an end plate, at least the lower one of said end plates having a central throughbore, said leveling device further comprising:

(a) a block member located between the upright members in resting engagement on the upper surface of the lower one of the end plates;

(b) said block member having a threaded throughbore in axial alignment with the throughbore of said lower end plate;

(c) a leveling screw in threaded engagement with said block in the bore thereof having a head portion projected above said block member and a foot portion retractable and extensible relative to the bottom surface of the lower end plate;

(d) said bottom surface of the lower end plate located on a load bearing surface for support of said foot portion of said leveling screw upon extension of said leveling screw from said axially aligned bores;

(e) a space above said head portion of said leveling screw between said upright members being open on at least one side thereof for accommodating the insertion and operation of a tool to rotate said leveling screw; and (f) means for securing said block member between the upright members and against said end plate whereby on extension or retraction of said leveling screw said beam is raised or lowered to horizontally adjust the form assembly.

2. The leveling device according to claim 1, wherein:

(a) said block member is substantially of an inverted T-shape in longitudinal cross section having a stem section and a base section;

(b) said throughbore extends axially through said stem section; and (c) said securing means are bolt assemblies that engage said base section.

3. The leveling device according to claim 1 wherein said form assembly includes a horizontal ground-supported beam extended transversely from and secured to the upright beam, further comprising:

(a) a leveling jack at a distal end portion of the horizontal beam which is opposite the end secured to said upright beam whereby on extension or retraction of said leveling jack said distal end of the horizontal beam is raised or lowered to adjustably plumb the form assembly.

* * * * *